US006945407B2

(12) United States Patent
Senior

(10) Patent No.: US 6,945,407 B2
(45) Date of Patent: Sep. 20, 2005

(54) FLOTATION OF SULPHIDE MINERALS

(75) Inventor: Geoff D Senior, Mount Claremont (AU)

(73) Assignee: WMC Resources Ltd., Perth (AU)

( * ) Notice: Subject to any disclaimer, the term of this patent is extended or adjusted under 35 U.S.C. 154(b) by 65 days.

(21) Appl. No.: 10/148,452

(22) PCT Filed: Nov. 30, 2000

(86) PCT No.: PCT/AU00/01479

§ 371 (c)(1),
(2), (4) Date: Sep. 18, 2002

(87) PCT Pub. No.: WO01/39888

PCT Pub. Date: Jun. 7, 2001

(65) Prior Publication Data

US 2003/0091484 A1 May 15, 2003

(30) Foreign Application Priority Data

Nov. 30, 1999 (AU) ..... PQ4378

(51) Int. Cl.[7] ..... B03D 1/02

(52) U.S. Cl. ..... 209/164; 209/166; 209/12.1; 209/3; 209/167

(58) Field of Search ..... 209/3, 12.1, 164, 209/166, 167

(56) References Cited

U.S. PATENT DOCUMENTS

| | | | | |
|---|---|---|---|---|
| 835,120 A | * | 11/1906 | Sulman | 209/166 |
| 955,012 A | * | 4/1910 | Sulman | 209/166 |
| 962,678 A | * | 6/1910 | Sulman | 209/166 |
| 1,236,934 A | * | 8/1917 | Higgins | 209/167 |
| 1,425,186 A | * | 8/1922 | Ridsdale | 209/166 |
| 1,722,598 A | * | 7/1929 | Stevens | 209/167 |
| 3,386,572 A | * | 6/1968 | Cadwell | 209/3 |
| 3,485,356 A | * | 12/1969 | Burr | 209/3 |
| 3,735,869 A | * | 5/1973 | Carpenter et al. | 209/726 |
| 3,919,079 A | * | 11/1975 | Weston | 209/166 |
| 4,222,529 A | * | 9/1980 | Long | 209/17 |

FOREIGN PATENT DOCUMENTS

| | | | |
|---|---|---|---|
| AU | 401720 | * | 11/1933 |
| AU | 120049 | | 6/1945 |
| DE | 150554 | * | 9/1981 |
| SU | 1315027 A1 | | 6/1987 |
| WO | 93/04783 | * | 3/1993 |

OTHER PUBLICATIONS

"Flotation Reagents and their Application"; A. Khan, L.I. Gabrielova, N.S. Vlasova; Moscow, NEDRA 1986; pp. 2–10.

"Benefication of Non–Ferrous Ores"; S.I. Pol'kin and A.V. Adamov; Moscow, "NEDRA", 1983.

Derwent Abstract Accession No. 89–218950, SU 1435301 A (Urals Br Halurgy), Jan. 12, 1987.

Derwent Abstract Accession No. 88–247893, SU 1373447 A (Extramural Poly) Feb. 15, 1988.

Derwent Abstract Accession No. 91–130600, SU 1567272 A (Dneprchermetavtomat) May 30, 1990.

* cited by examiner

*Primary Examiner*—Thomas M. Lithgow
(74) *Attorney, Agent, or Firm*—Miles & Sotckbridge P.C.; Edward J. Kondracki

(57) ABSTRACT

The present invention relates generally to a process and an apparatus for flotation of sulphide minerals, such as sulphide minerals hosted in ores rich in magnesium minerals. The process involves grinding of the nickel ore rich in magnesium minerals and thereafter separation of the ground material into a coarse and fine stream of particles coarser than about 30 microns and finer than about 30 microns, respectively. Optionally, the fines stream may be further separated into a slimes fraction. The coarse and fine flotation streams are then fit to separate parallel flotation circuits. Acid and/or activator is added during flotation of the coarse stream only. Significantly improved recoveries and grades were obtained with reduced acid consumption.

15 Claims, 3 Drawing Sheets

FLOTATION OF SULPHIDE MINERALS

FIELD OF THE INVENTION

The present invention relates generally to a process and an apparatus for flotation of sulphide minerals including, but not limited to, sulphide minerals hosted in ores rich in magnesium minerals.

BACKGROUND TO THE INVENTION

A conventional mineral processing technique for separating sulphide minerals from an ore rich in magnesium minerals involves the following steps:

(i) crushing and wet milling of the ore to form a pulp having particles of a desired particle size distribution;

(ii) adding frother, collector and depressant to the pulp;

(iii) adding acid to the pulp;

(iv) adding an activator to the pulp; and (v) flotation of the pulp in one or more stages wherein the sulphide minerals are separated from gangue minerals.

The addition of collector makes the sulphide minerals hydrophobic and the addition of depressant minimises the recovery of gangue materials to the flotation concentrate. The addition of acid and activator enhances the effect of the collector and, in turn, improves the recovery and/or the grade. The flotation concentrate of valuable sulphide minerals is filtered and dried in preparation for smelting, or other secondary treatment processes such as leaching. For smelting or for other secondary processing, the amount of gangue, particularly magnesium bearing gangue, should be minimised.

It is generally known that improved activity of valuable sulphide minerals and reduced recovery of gangue can be obtained by adding acid to lower the pH or by adding an activator such as copper sulphate. Unfortunately, for many magnesium bearing ores, the addition of acid or activator is relatively ineffective. Often to obtain any discernible improvement, large amounts of acid or activator have to be added and the economic benefits are, more often than not, out-weighed by the cost of the reagents. This is particularly so for nickel ores containing large amounts of magnesium bearing minerals.

A number of strategies have been employed to reduce the consumption of acid and activator including:

(i) making a sand/slime separation at a cut size of about 10 micron and adding acid and activator to the sands fraction (nominally +10 micron) only which contains less fine magnesium bearings minerals than the slimes fraction (nominally −10 micron), or (ii) adding acid and activator to low volume, high value streams only such as cleaner feed or recleaner feed.

These strategies tend to be relatively ineffective and their applications are restricted, or the benefits are limited or both. For example, both acid and activator have little effect when added to a sands stream of over 10 micron at the Mt Keith, Western Australia, concentrator of WMC Resources Limited which treats a low grade nickel sulphide ore high in magnesium bearing minerals.

SUMMARY OF THE INVENTION

According to one aspect of the present invention there is provided a method of pretreating a sulphide mineral comprising the steps of grinding the sulphide mineral and performing a size separation at between 20 to 50 micron to provide a coarse stream and a fine stream wherein gangue is minimised in the coarse stream.

According to another aspect of the present invention there is provided a process for flotation of a sulphide mineral, said process comprising the steps of:

separating a flotation pulp containing valuable sulphide minerals into at least a coarse stream and a fine stream, said size separation being effected at a relatively coarse level; and treating predominantly the coarse stream with acid and/or activator whereby the benefits of acid and/or activator conditioning can be substantially realised.

Preferably the relatively coarse level is between about 20 to 50 micron. More preferably the size separation is effected at between about 25 to 45 micron.

Typically the coarse stream only is treated with moderate amounts of an acid and/or activator.

More typically the fine stream is floated in a conventional manner without the addition of acid and/or activator.

It has been found that by treating predominantly the coarse stream with acid and/or activator, the efficiency of flotation is improved markedly compared with that achieved by treating the whole ore. The relatively coarse size separation and subsequent flotation is also significantly more efficient than conditioning of the sands fraction from a sands/slimes separation. Moreover, the amount of acid and activator required is much less where the relatively coarse size separation is made.

Preferably the size separation is performed using one or more cyclones. More preferably the size separation is effected using a plurality of cyclones arranged in series Alternatively the size separation is conducted using screens.

Typically the fine stream contains particles predominantly finer than about 30 micron and the coarse stream contains particles predominantly coarser than 30 micron. The amount of misreporting particles needs to be kept to a minimum in ways known to those skilled in the art. Optionally a slimes fraction may be further separated from the fines fraction.

Preferably, the fine stream is floated at a relatively low solid/liquid ratio. This avoids the tendency for pulps to become viscous and lowers the recovery of fine magnesium minerals into the froth by physical carry-over with the water, the so-called entrainment effect. It is known that the presence of some magnesium minerals causes pulps to become readily viscous which, in turn, reduces the dispersion of air in flotation cells.

Preferably, the acid and/or activator is added during one or more of the following stages: coarse stream conditioning; coarse stream rougher bank; coarse stream middling bank; coarse stream scavenging bank; coarse stream cleaning bank, and/or coarse stream re-cleaning bank.

Preferably the coarse stream is treated with an acid selected from the group consisting of sulphuric acid, hydrochloric acid, nitric acid, sulphurous acid, sulphamic acid, or some other suitable inorganic/organic acid.

Preferably the coarse stream is treated with an activator selected from the group consisting of copper sulphate, lead nitrate, sodium sulphide, sodium hydrogen sulphide, sodium hydrosulphide or some other inorganic or organic reagent known by those skilled in the art to promote the flotation of sulphide minerals, particularly nickel sulphide minerals.

According to another aspect of the present invention there is provided an apparatus for flotation of sulphide minerals, said apparatus comprising:

means for separating a flotation pulp containing valuable sulphide minerals into at least a coarse stream and a fine stream, said size separation being effected at a relatively coarse level; and means for treating predominantly the coarse stream with acid and/or activator whereby the benefits of acid and/or activator conditioning can be substantially realised.

Typically the fine stream is treated in a conventional manner in a conventional flotation circuit.

Preferably the means for treating the coarse stream comprises a coarse stream conditioning tank, a coarse stream rougher bank, a coarse stream middlings bank, a coarse stream scavenger bank, a coarse stream cleaner bank and/or a coarse stream re-cleaner bank, to which the acid and/or activator are added to one or more of the apparatus. Typically, the acid and/or the activator are added to a conditioning tank, a pipe/chute and/or a flotation cell.

Preferably the means for separating the pulp into a coarse stream and a fine stream comprises a cyclone. More preferably the cyclone is one of clusters of cyclones of different sizes arranged in series.

BRIEF DESCRIPTION OF THE DRAWINGS

In order to facilitate a better understanding of the nature of the invention several embodiments of the process and apparatus for flotation of sulphide minerals will now be described in detail, by way of example only, with reference to the accompanying drawings, in which.

DETAILED DESCRIPTION OF THE PREFERRED EMBODIMENTS

Figure 1:
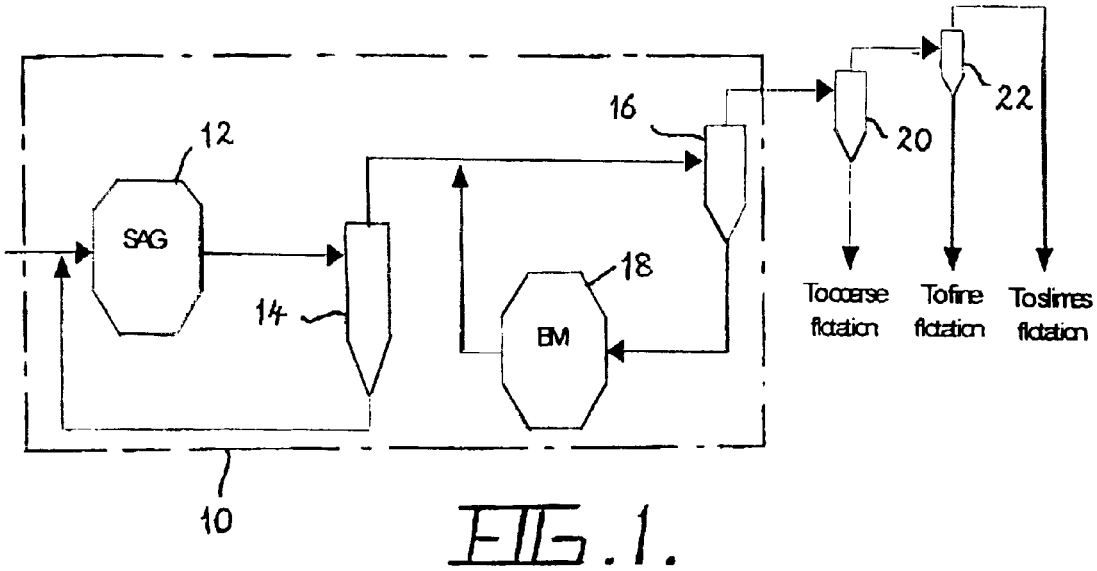
FIG. 1 illustrates schematically an embodiment of a grinding and classification circuit capable of producing a coarse stream suitable for conditioning or flotation with acid or activator in accordance with the present invention.

The present invention is based on the discovery that the effectiveness of acid and/or activator is greatly increased by separating the flotation feed into a relatively coarse stream and a fine stream, and then adding acid and/or activator to the coarse stream only. Preferably the coarse stream contains particles coarser than about 30 microns whilst the fine stream contains particles finer than about 30 microns. Separation of the slurry or flotation pulp into coarse and fine fractions is normally effected by cyclones, but may be effected by other means including, but not limited to, screen decks. FIG. 1 illustrates schematically an embodiment of a grinding and classification circuit capable of producing a coarse stream suitable for conditioning with acid and/or activator. In this embodiment the fine fraction passes through a further stage of cyclones to separate a slimes fraction. The separation of slimes, in this way, is optional.

Coarse and fine particles are separated on the basis of size, though it is recognised that cyclones to some extent also separate on the basis of density. In this example, the nominal size of separation is between 20 and 50 micron with the range between 25 and 45 micron being particularly preferred. It is recognised that some particles will inevitably report to the incorrect stream in an industrial device like a cyclone, but that the amount of misreporting particles can be kept to a minimum in ways known to those skilled in the art. For example, the efficiency of size separation can usually be optimised by adding the correct amount of water to the feed slurry, by correct selection of cyclone dimensions and operating pressure, and by appropriate selection of spigot and vortex finder sizes.

In this embodiment, a nickel ore rich in magnesium minerals is crushed and ground such that 80% of the mass passes 160 micron. The grinding circuit 10 is a closed circuit with cyclones such that all the oversized material is returned for further grinding while the ground material is presented to the next stage of the process. The ore is initially ground in a semi autogenous grinding (SAG) mill 12 and oversized material is returned to the SAG mill for further grinding via first grinding cyclones 14. Ground ore from the first grinding cyclones 14 is presented to second grinding cyclones 16 and oversized ore from the second grinding cyclones 16 is returned to a ball mill 18 for further grinding.

The next stage of the process involves classification of the grinding product into coarse, and fine streams and, optionally, a slimes fraction. In this embodiment, separation into a coarse stream, a fines stream and a slimes stream is effected using cyclones of different sizes such as cyclones 20 and 22 arranged in series. The diameter of the first cyclones 20 in the series may be 100 mm, while the diameter of the second cyclones 22 in the series may be 50 mm. The overflow from the first cyclones 20 becomes the feed to the second cyclones 22. The underflow from the first cyclones 20 becomes the coarse feed to a flotation circuit (not illustrated), while the underflow from the second cyclones 22 becomes the feed to a second, separate flotation circuit. The overflow from the second cyclones 22 becomes the slimes feed to a third flotation circuit. It will be understood that in some systems separation of a slimes fraction will not be necessary and the overflow from the first series of cyclones 20 will be the feed to the fines circuit.

The coarse and fine flotation streams are then preferably fed to separate parallel flotation circuits. The slimes stream, if produced, may be treated in a third parallel flotation circuit or, if appropriate, discarded. During flotation of the coarse stream, acid and/or activator is added. The acid and/or activator may be added at the conditioning, roughing, scavenging, cleaning or re-cleaning stage of the coarse stream flotation circuit. The amount of acid and/or activator which must be added will depend on a range of factors including:

(a) the type of ore;

(b) conditioning time;

(c) percents solids of the pulp; and (d) pre-treatments/processing of the slurry.

Figure 2:
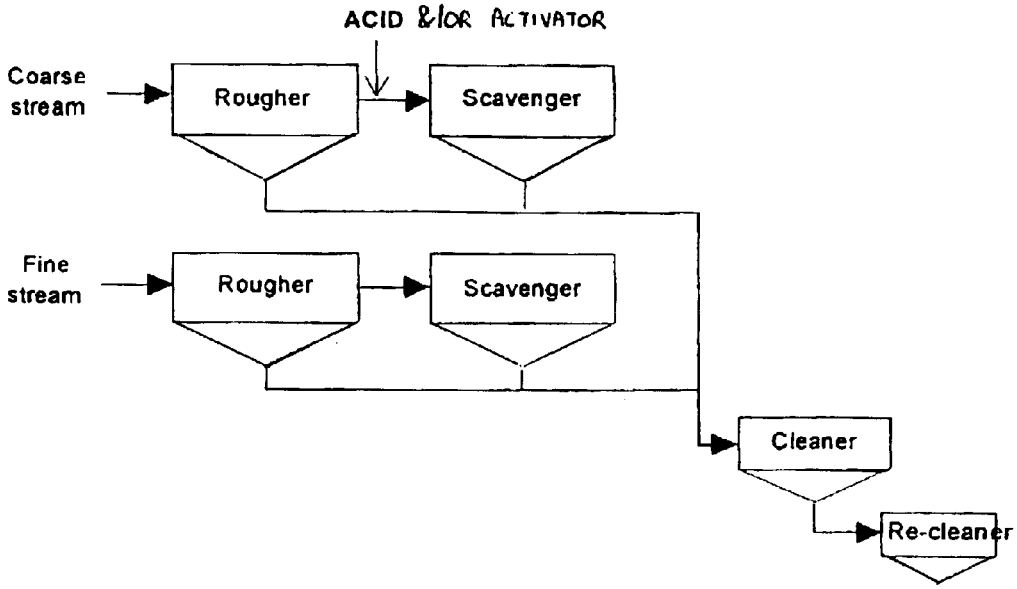
FIG. 2 is a schematic diagram illustrating a simplified flotation circuit with the coarse stream being conditioned with acid and/or activator in accordance with a first embodiment of the present invention.

For example, test work has been conducted using different types of Mount Keith, Western Australia, ore all high in magnesium bearing minerals. The conditioning time was two minutes and the percent solids in the coarse stream was 30% and that in the fines stream was 10%. In the test work, acid conditioning was performed on coarse streams that had been passed through a rougher but not yet through a scavenger in the flotation circuit, as illustrated in FIG. 2. The coarse stream was separated using a first series of cyclones and contained mostly particles coarser than 30 micron. The fine stream was separated using a second series of smaller cyclones and contained mostly particles finer than 30 micron and coarser than 10 micron. The particles finer than 10 micron reported to a slimes fraction which was not processed further.

In the test work, acid was added at a rate of between 1 and 3 kg/t as calculated with respect to the whole ore. For each ore type tested, a reference or comparative sample was tested using conventional sands flotation, that is the underflows from cyclones 20 and 22 were combined for flotation.

Table 1 compares the results of the rougher-scavenger stage of these embodiments of the improved flotation process with those of the rougher-scavenger stage of the conventional process of sands flotation. "A" and "R" correspond to the Grade (%) and Recovery (%) respectively. Thirteen different ore types were tested and for each type the improved process gave significantly better recovery and/or grade for Nickel than the conventional process. For some ore types, the improvement in recovery was particularly large, see for example over 10% for ore type "L". In addition, for all types of ores, the grade either remained much the same or improved.

TABLE 1

Improvements brought about by the new process.

| Ore type | | | Ni | Fe | MgO |
|---|---|---|---|---|---|
| A | Std Method | A | 3.80 | 8.80 | 32.70 |
| | | R | 68.5 | 20.5 | 9.8 |
| | New Process | A | 3.89 | 9.33 | 31.1 |
| | 2.7 kg/t $H_2SO_4$ | R | 76.7 | 23.4 | 10.1 |
| B | Std Method | A | 4.75 | 11.74 | 29.74 |
| | | R | 60.4 | 14.7 | 4.8 |
| | New Process | A | 5.24 | 13.3 | 28.2 |
| | 2.4 kg/t $H_2SO_4$ | R | 65.2 | 16.3 | 4.6 |
| C | Std Method | A | 3.30 | 7.78 | 33.19 |
| | | R | 61.8 | 15.1 | 8.0 |
| | New Process | A | 3.88 | 10.9 | 30.58 |
| | 1.5 kg/t $H_2SO_4$ | R | 66.3 | 18.9 | 6.8 |
| D | Std Method | A | 3.71 | 8.88 | 33.03 |
| | | R | 70.1 | 21.9 | 10.4 |
| | New Process | A | 6.90 | 9.70 | 27.61 |
| | 1.7 kg/t $H_2SO_4$ | R | 76.2 | 20.3 | 5.1 |
| E | Std Method | A | 4.25 | 9.66 | 33.29 |
| | | R | 65.2 | 18.8 | 8.4 |
| | New Process | A | 6.00 | 12.85 | 29.52 |
| | 1.5 kg/t $H_2SO_4$ | R | 74.2 | 20.2 | 5.9 |
| F | Std Method | A | 6.09 | 12.64 | 29.66 |
| | | R | 70.1 | 18.5 | 5.6 |
| | New Process | A | 7.24 | 15.41 | 27.00 |
| | 1.7 kg/t $H_2SO_4$ | R | 75.2 | 20.1 | 4.5 |
| G | Std Method | A | 4.06 | 9.42 | 33.05 |
| | | R | 65.8 | 18.6 | 8.2 |
| | New Process | A | 5.13 | 11.81 | 30.45 |
| | 1.3 kg/t $H_2SO_4$ | R | 71.3 | 19.4 | 6.4 |
| H | Std Method | A | 6.19 | 12.73 | 28.39 |
| | | R | 71.5 | 17.6 | 5.2 |
| | New Process | A | 7.16 | 15.09 | 26.97 |
| | 1.4 kg/t $H_2SO_4$ | R | 73.7 | 19.4 | 4.6 |
| I | Std Method | A | 9.38 | 17.14 | 23.8 |
| | | R | 69.8 | 15.2 | 2.9 |
| | New Process | A | 10.19 | 19.55 | 21.49 |
| | 0.8 kg/t $H_2SO_4$ | R | 76.6 | 17.7 | 2.6 |
| J | Std Method | A | 9.33 | 15.44 | 25.31 |
| | | R | 70.1 | 15.0 | 3.1 |
| | New Process | A | 12.9 | 20.84 | 19.01 |
| | 1.5 kg/t $H_2SO_4$ | R | 75.5 | 15.4 | 1.7 |
| K | Std Method | A | 9.97 | 17.63 | 22.98 |
| | | R | 66.3 | 14.5 | 2.4 |
| | New Process | A | 12.64 | 23.21 | 17.04 |
| | 1.0 kg/t $H_2SO_4$ | R | 72.4 | 16.6 | 1.5 |
| L | Std Method | A | 9.01 | 15.15 | 25.8 |
| | | R | 62.8 | 12.9 | 2.7 |
| | New Process | A | 9.95 | 17.66 | 23.25 |
| | 1.6 kg/t $H_2SO_4$ | R | 74.1 | 16.4 | 2.7 |

TABLE 1-continued

Improvements brought about by the new process.

| Ore type | | | Ni | Fe | MgO |
|---|---|---|---|---|---|
| M | Std Method | A | 5.5 | 15.23 | 26.78 |
| | | R | 70.4 | 23.2 | 6.0 |
| | New Process | A | 7.96 | 19.68 | 21.4 |
| | 1.2 kg/t $H_2SO_4$ | R | 72.8 | 21.1 | 3.4 |

Further comparative tests were conducted involving conventional flotation and the addition of acid. These comparative tests were intended to confirm that the improvement brought about by the improved flotation process could not be brought about by adding the same or even larger additions of acid to the sands stream. The results of these tests are presented in Table 2, from which it can be seen that for only two ore types, namely ore types 4 and 5, did the addition of acid bring about any improvement in recovery, and even then the improvement was small, just over 1 percent. For the majority of the ore types, the results were worse when the acid was added to the sands stream. Particularly large decreases in recovery occurred for high additions of acid and it was noted that under these conditions the froth became unstable, possibly owing to the decomposition of reagents brought about by the low pH of the pulp.

TABLE 2

Conventional rougher-scavenger flotation with and without acid.

| Ore Type | | | Ni | Fe | MgO |
|---|---|---|---|---|---|
| 1 | Std Method | Grade (%) | 4.36 | 8.73 | 34.2 |
| | | Recovery (%) | 76.0 | 19.9 | 8.6 |
| | Std Method | Grade (%) | 5.67 | 10.5 | 32.3 |
| | 47.4 kg/t $H_2SO_4$ | Recovery (%) | 72.9 | 19.2 | 6.8 |
| 2 | Std Method | Grade (%) | 7.01 | 14.7 | 27.2 |
| | | Recovery (%) | 80.3 | 20.6 | 4.8 |
| | Std Method | Grade (%) | 5.93 | 12.9 | 29.8 |
| | 9.1 kg/t $H_2SO_4$ | Recovery (%) | 72.14 | 19.6 | 5.7 |
| 3 | Std Method | Grade (%) | 4.25 | 10.2 | 34.3 |
| | | Recovery (%) | 80.6 | 25.3 | 10.8 |
| | Std Method | Grade (%) | 4.19 | 10.4 | 33.6 |
| | 2.5 kg/t $H_2SO_4$ | Recovery (%) | 78.5 | 27.5 | 11.2 |
| 4 | Std Method | Grade (%) | 3.99 | 9.73 | 34.6 |
| | | Recovery (%) | 79.8 | 26.4 | 11.8 |
| | Std Method | Grade (%) | 4.29 | 10.4 | 33.9 |
| | 1.7 kg/t $H_2SO_4$ | Recovery (%) | 80.9 | 26.3 | 10.8 |
| 5 | Std Method | Grade (%) | 4.92 | 11.5 | 32.5 |
| | | Recovery (%) | 79.1 | 23.8 | 8.8 |
| | Std Method | Grade (%) | 4.75 | 11.3 | 32.9 |
| | 0.8 kg/t $H_2SO_4$ | Recovery (%) | 79.3 | 24.9 | 9.2 |
| 6 | Std Method | Grade (%) | 8.09 | 12.9 | 28.0 |
| | | Recovery (%) | 73.1 | 15.9 | 4.5 |
| | Std Method | Grade (%) | 7.29 | 12.5 | 29.1 |
| | 0.1 kg/t $H_2SO_4$ | Recovery (%) | 72.4 | 16.4 | 5.0 |

In assessing the data in Table 2 it should be noted that the additions tested spanned the range that brought about the marked improvement using the improved flotation process shown in Table 1.

A further advantage of this embodiment of the present invention is that after acid treatment of the coarse stream and removal of the valuable mineral phase, the tailings from the coarse and fine streams may be combined following flotation This allows the acid in the coarse stream to be neutralised by the acid-neutralising phases that concentrate preferably in the fine stream. In this way, the tailings product may be more readily disposed of, as it is not as acidic.

The invention in another example has been tested on an ore type from a different deposit other than from Mt Keith.

This additional ore type assayed 1.62% Ni, a figure which is much higher than that for the Mt Keith ore types in Tables 1 and 2. The additional ore type still contained, however, large amounts of magnesium bearing minerals, assaying 30.1% MgO.

Two laboratory flotation tests were conducted on the additional ore. The first was a reference test using standard methods that had previously been found to give an optimal result. The second was a test using the improved flotation process of an embodiment of the invention. For both tests, the ore was ground using known laboratory techniques. For the test using an embodiment of the improved process, the coarse stream was treated with 100 g/t of an activator in the form of copper sulphate. This addition was calculated with respect to the whole ore. In this embodiment no acid was added.

The results of the tests are shown in Table 3 from which it can be seen that recovery was raised by over 6% using this example of the improved method, without an unacceptable loss of concentrate grade. Recovery of 81.5% of the nickel brought about by the improved process from a concentrate assaying 14.0% Ni could not previously be achieved using conventional methods.

TABLE 3

Comparison of results for the new process compared with the previous optimal results (laboratory batch testing of high Ni grade ore).

| Conditions | % Ni | |
|---|---|---|
| Standard Method | Grade | 14.6 |
| | Recovery | 75.0 |
| New Process | Grade | 14.0 |
| 100 g/t $CuSO_4$ | Recovery | 81.5 |

Figure 3:
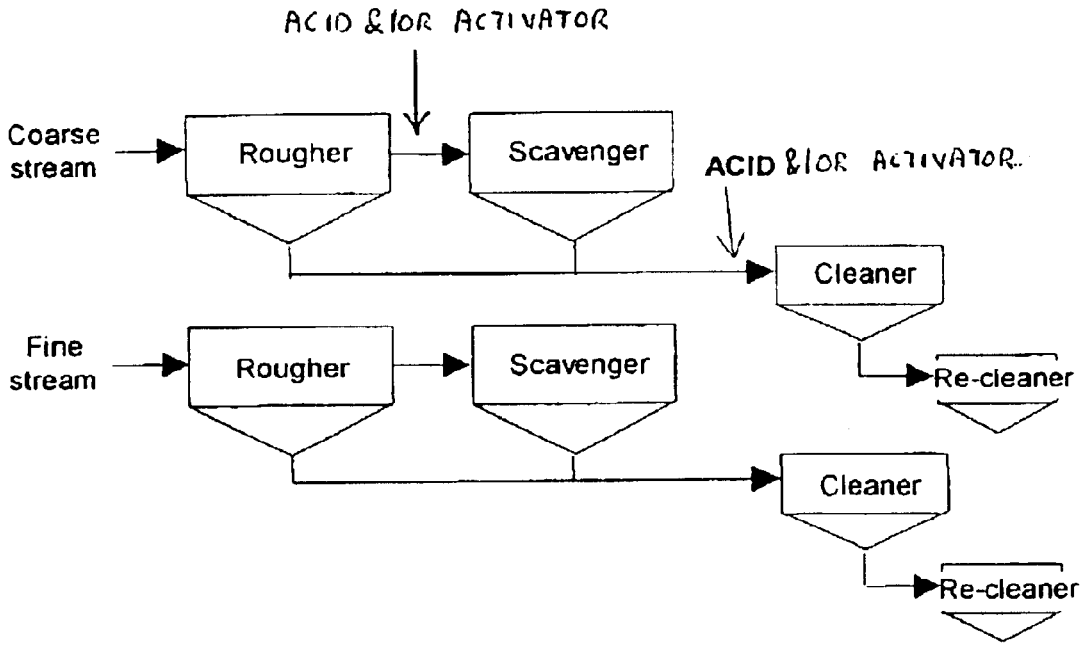
FIG. 3 is a schematic diagram illustrating a simplified flotation circuit with the coarse stream being conditioned with acid and/or activator in accordance with a second embodiment of the present invention.

FIG. 3 illustrates a second embodiment of a simplified flotation circuit in which the advantages of isolating a coarse stream for conditioning/flotation in the presence of acid and/or activator are combined with the advantages of adding a further addition of acid or activator to a subsequent low volume, high value stream such as the cleaner feed. In this case, the basic flotation circuit is similar to that of FIG. 2, except that the separate flotation of the coarse and the fine streams is continued into the cleaners. Acid and/or activator are added in the coarse cleaner circuit in addition to the acid and/or activator added at one or more points in the rougher scavenger circuit.

Figure 4:
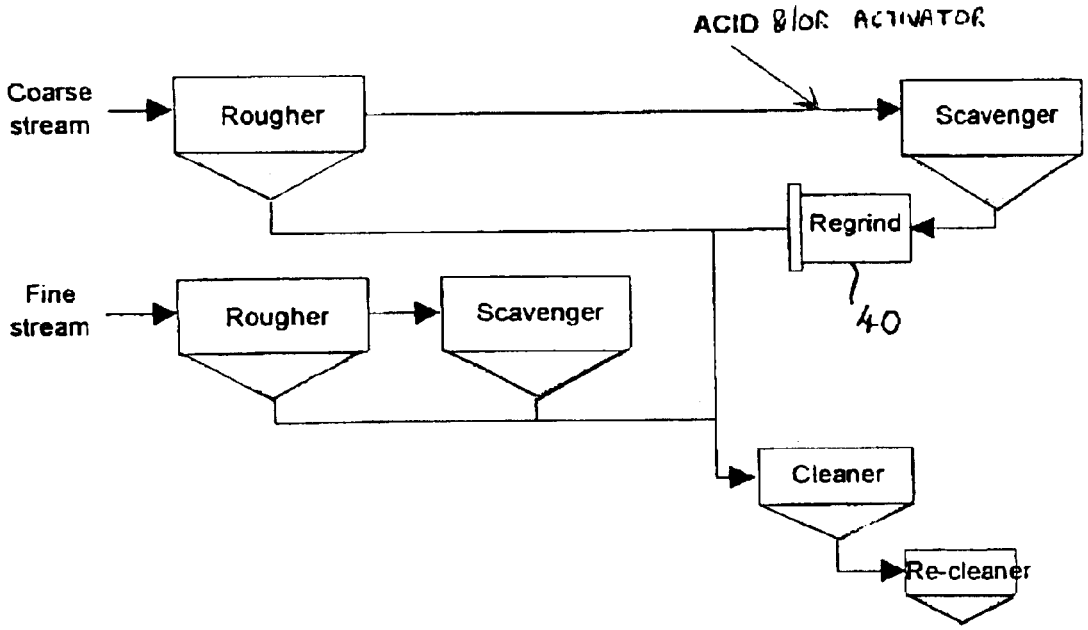
FIG. 4 is a schematic diagram illustrating a simplified flotation circuit with the coarse stream being conditioned with acid and/or activator in accordance with a third embodiment of the present invention.

FIG. 4 illustrates a third embodiment of a simplified flotation circuit in which the benefits of adding acid and/or activator to the coarse stream are further enhanced by incorporating a regrind on the coarse stream scavenger concentrate. The basic flotation circuit is similar to that of FIG. 2, except that a regrind mill 40 is provided for regrinding the concentrated mineral pulp from the coarse stream scavenger flotation cell. In this way, the advantages of using acid and/or activator to enhance the flotation of coarse composite particles are more fully exploited by regrinding the scavenger concentrate. The reground scavenger concentrate can then be combined with the coarse rougher concentrate and the fine stream concentrate through the cleaning circuit as in FIG. 2. Recycled streams and/or desliming of the regrind product are omitted for clarity.

Figure 5:
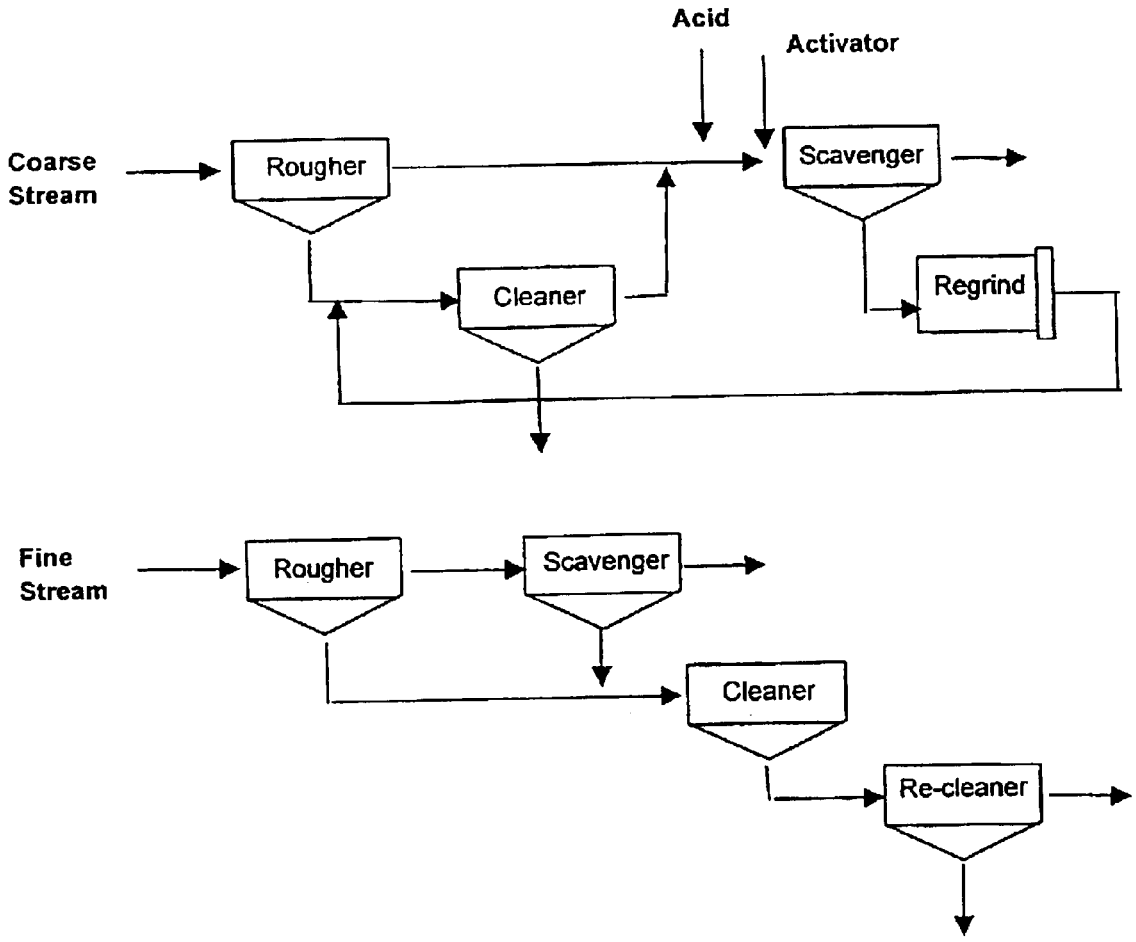
FIG. 5 is a schematic diagram illustrating a simplified flotation circuit with the coarse stream being conditioned with acid and/or activator in accordance with a fourth embodiment of the present invention.

FIG. 5 illustrates a fourth embodiment of a simplified flotation circuit in which the benefits of adding acid and/or activator to the coarse stream are further enhanced by incorporating a regrind on the coarse scavenger concentrate and an additional cleaning circuit to clean only the product from the coarse stream. The basic flowsheet is similar to that of FIG. 2, except that a regrind mill 40 is provided for regrinding the concentrated mineral pulp from the coarse scavenger flotation cell and an additional cleaner circuit is provided to clean the reground product together with the concentrated mineral pulp from the coarse rougher bank. The tailings from the cleaner bank can then be recycled to the head of the scavenger bank for further conditioning with acid and/or activator. Alternatively, the tailings from the cleaner bank can be recycled to other parts of the flotation circuit or discarded (not shown for clarity).

From the above description of several embodiments of the improved process and apparatus for flotation of sulphide minerals, it is evident that it is advantageous to effect a size separation and then treat the coarse fraction only with acid and/or activator. Preferably the size separation is within a particular range, significantly coarser than that used for sands/slimes separations, and treating the coarse fraction only with acid and/or activator provides a number of significant, previously unavailable, advantages These advantages include, but are not necessarily limited to, the following:

(i) significantly improved recovery and grades;

(ii) reduced acid consumption due to the acid consuming minerals reporting to the fine fraction;

(iii) flotation of the fine fraction at low pulp densities which, in turn, brings about more selective separations from fine magnesium bearing minerals;

(iv) particularly strong flotation of coarse composite particles which respond well to acid and to activator and to both when separated from the fine particles;

(v) flotation of low grade, coarse composite particles that are suitable for regrinding, but which otherwise would be lost from the process;

(vi) reduced dissolution of the fine mineral values in the acid; and, (vii) the opportunity to reduce/eliminate the environmental impact of acid conditioning by the ability to recombine the coarse and fine streams after acid treatment, but prior to disposal thereby utilising the acid neutralising capacity of the fine stream.

Numerous variations and modifications to the described process and apparatus will suggest themselves to persons skilled in the mineral processing arts, in addition to those already described, without departing from the basic inventive concepts. All such variations and modifications are to be considered within the scope of the present invention, the nature of which is to be determined from the foregoing description.

In the claims which follow and in the preceding summary of the invention, except where the context requires otherwise due to express language or necessary implication, the word "comprising" is used in the sense of "including", that is the features specified may be associated with further features in various embodiments of the invention.

It is to be understood that, if any prior art information is referred to herein, such reference does not constitute an admission that the information forms part of the common general knowledge in the art.

What is claimed is:

1. A process for flotation of a sulphide mineral containing nickel, said process comprising the steps of:

separating a flotation pulp containing valuable sulphide minerals into at least a coarse stream and a fine stream, said size separation being effected at a relatively coarse level in the range of 20 to 50 microns;

treating predominantly the coarse stream with acid and/or copper sulphate to facilitate flotation of coarse particles containing nickel; and floating the coarse and fine streams in separate flotation stages, wherein the fine stream has a relatively lower solid/liquid ratio than the coarse stream.

2. A process for flotation of a sulphide mineral as defined in claim 1 wherein the size separation is effected at between about 25 to 45 micron.

3. A process for flotation of a sulphide mineral as defined in claim 1 wherein the coarse stream only is treated with moderate amounts of the acid and/or copper sulphate.

4. A process for flotation of a sulphide mineral as defined in claim 1 wherein the size separation is performed using one or more cyclones.

5. A process for flotation of a sulphide mineral as defined in claim 4 wherein the size separation is effected using a plurality of cyclones arranged in series.

6. A process for flotation of a sulphide mineral as defined in claim 1 wherein the acid and/or copper sulphate is added during one or more of the following stages: coarse stream conditioning; coarse stream rougher bank; coarse stream middling bank; coarse stream scavenging bank; coarse stream cleaning bank, and/or coarse stream re-cleaning bank.

7. A process for flotation of a sulphide mineral as defined in claim 1 wherein the coarse stream is treated with an acid selected from the group consisting of sulphuric acid, hydrochloric acid, nitric acid, sulphurous acid, sulphamic acid, or other suitable inorganic/organic acid.

8. A process for flotation of a sulphide material as defined in claim 1, wherein the coarse stream only is treated with moderate amounts of the acid and/or copper sulphate.

9. A process for flotation of a sulphide mineral as defined in claim 8 wherein the size separation is performed using one or more cyclones.

10. A process for flotation of a sulphide mineral as defined in claim 9 wherein the fine stream is floated at a relatively low solid/liquid ratio.

11. A process for flotation of a sulphide mineral as defined in claim 10 wherein the acid and/or activator is added during one or more of the following stages: coarse stream conditioning; coarse stream rougher bank; coarse stream middling bank; coarse stream scavenging bank; coarse stream cleaning bank, and/or coarse stream re-cleaning bank.

12. A method of pretreating a sulphide mineral prior to flotation, said method comprising the steps of grinding the sulphide mineral and performing a size separation at between 20 to 50 micron to provide a coarse stream and fine stream wherein gangue is minimized in the coarse stream; and wherein the coarse stream only is treated with moderate amounts of an acid and/or copper sulphate.

13. A method of pretreating a sulphide mineral prior to flotation as defined in claim 12 wherein the size of separation is effected at between about 25 to 45 micron.

14. A method of pretreating a sulphide mineral prior to flotation as defined in claim 12 wherein the size separation is effected using a plurality of cyclones arranged in series.

15. A method of pretreating a sulphide mineral prior to flotation as defined in claim 12 wherein the size separation is effected using a plurality of cyclones arranged in series.

* * * * *

UNITED STATES PATENT AND TRADEMARK OFFICE

CERTIFICATE OF CORRECTION

PATENT NO. : 6,945,407 B2
DATED : September 20, 2005
INVENTOR(S) : Geoff D. Senior It is certified that error appears in the above-identified patent and that said Letters Patent is hereby corrected as shown below:

Column 10,
Line 30, change "12" to -- 13 --.
Line 30, change "12" to -- 16 --.
Line 31, add -- 16 A method of preparing a sulphide mineral prior to flotation as defined in Claim 15 wherein the course stream only is treated with moderate amounts of an acid and/or activator --.

Signed and Sealed this

Sixteenth Day of May, 2006

JON W. DUDAS
*Director of the United States Patent and Trademark Office*